US006538568B2

(12) United States Patent
Conley, III

(10) Patent No.: US 6,538,568 B2
(45) Date of Patent: Mar. 25, 2003

(54) EMERGENCY LIGHTING REMOTE MONITORING AND CONTROL SYSTEM

(75) Inventor: William H. Conley, III, Marana, AZ (US)

(73) Assignee: Iota Engineering Co., Tucson, AZ (US)

( * ) Notice: Subject to any disclaimer, the term of this patent is extended or adjusted under 35 U.S.C. 154(b) by 58 days.

(21) Appl. No.: 09/746,727

(22) Filed: Dec. 21, 2000

(65) Prior Publication Data

US 2002/0080027 A1 Jun. 27, 2002

(51) Int. Cl.[7] ..... G08B 21/00
(52) U.S. Cl. ..... 340/540; 340/3.7; 315/86
(58) Field of Search ..... 340/540, 3.7, 333, 340/825.72, 825.69, 635, 641, 825.71; 315/86; 362/95

(56) References Cited

U.S. PATENT DOCUMENTS 4,063,108 A * 12/1977 Klett et al. ..... 307/64
4,799,039 A * 1/1989 Balcom et al. ..... 340/333
5,148,158 A 9/1992 Shah ..... 340/825
5,154,504 A * 10/1992 Helal ..... 340/531
5,666,029 A 9/1997 McDonald ..... 315/86
6,285,132 B1 * 9/2001 Conley, III et al. ..... 315/86

* cited by examiner

*Primary Examiner*—Anh La
(74) *Attorney, Agent, or Firm*—Durando Birdwell & Janke, PLC

(57) ABSTRACT

An emergency lighting monitoring and control system controls and monitors the emergency lights in a building. A central control unit automatically schedules self tests for each of the emergency lights and stores the results of the tests in memory. The self tests include tests of the backup power source and the lamp. Some failures are predicted prior to actual failure. Failures are diagnosed and repairs are suggested. Light output is automatically monitored and adjusted. The central control unit generates a report of the self tests and notifies an operator of failures. An operator views test reports, controls the emergency lights, and schedules tests. The system automatically detects newly installed emergency lighting units.

18 Claims, 4 Drawing Sheets

EMERGENCY LIGHTING REMOTE MONITORING AND CONTROL SYSTEM

BACKGROUND OF THE INVENTION

1. Field of the Invention

This invention is related in general to the field of emergency lighting and, in particular, to remote control and monitoring of emergency lights.

2. Description of the Related Art

Emergency lighting is required by most safety codes in the United States. Emergency lights provide temporary lighting in the event of a power failure. During normal operation, power is provided from power mains to operate the lamp and to charge a backup power source (e.g., a battery). When power from the mains is interrupted, the backup power source provides power to the lamp for a limited time (typically 90 minutes).

It is desirable to test emergency lights periodically to ensure proper operation. A typical prior art self test is initiated by a person pushing a button or flipping a switch on the lighting unit. Simple voltage and/or current tests are performed and a light or buzzer is activated if a test fails.

There are several problems with the prior art. One problem is that safety codes typically require a brief (i.e., 30 seconds) test be performed every month and a longer (i.e., 90 minutes) test be performed each year. The prior art requires a person to manually initiate, monitor, and record each of these tests. This is a large problem in a building which has many emergency lighting units. Consequently, testing is easily neglected, records of the tests are easily lost, and costs for personnel to perform the testing and recording of the test results are incurred.

Many systems and methods have been devised to perform emergency lamp testing. One such system is disclosed in U.S. Pat. No. 5,666,029, issued Sep. 9, 1997 to McDonnell and is incorporated herein by reference. McDonnell describes a self test circuit and method for testing the emergency ballast for a flourescent lamp. It describes circuits for measuring backup power source voltage and current to the lamp. McDonnell, however, does not provide a solution to the several problems mentioned above. A person must still manually initiate the self test, monitor the test, and record the test results.

Another reference is disclosed in U.S. Pat. No. 5,148,158, issued Sep. 15, 1992 to Shah. Shah describes an emergency lighting unit with remote test capability. The lighting unit taught by Shah can initiate a self test via a hand-held remote control. Shah's invention eliminates the need for a person to press a test button mounted on the emergency lighting unit. An operator uses a remote controller to initiate tests from a distance of several yards from the lighting unit. However, Shah fails to provide a solution to several problems. Using Shah's invention, a person must still manually initiate the self test, monitor the test, and manually record the results of the tests.

Another problem with the prior art is that repairs and adjustments are done manually. This is expensive and time consuming. These tasks require that a person manually test the lighting unit, verify that a problem exists, diagnose the problem, and fix the problem.

Clearly there exists the need for an improved emergency lighting test system which automatically initiates emergency lighting tests, monitors the results of the tests, automatically records test results, performs these functions from one central location, monitors lamp light output, adjusts lamp light output, diagnoses failures, predicts failures, is a simple design, and is cost effective.

BRIEF SUMMARY OF THE INVENTION

The invention discloses an emergency lighting monitoring and control system which remotely controls, monitors, and tests the emergency lights in a building. A central control unit schedules tests for each of the emergency lights, remotely initiates the tests, monitors the test results, stores test reports, and notifies an operator of failures. The self tests include backup power source tests and lamp tests. Some problems are automatically fixed by the system. The system predicts failures and suggests which component to replace when a test fails. An operator can program new test schedules, turn the emergency lights on and off, and view the test reports. The system is expandable and automatically detects newly installed emergency lighting units.

The central control unit communicates with all of the emergency lights in the building using wireless technology. The invention significantly reduces costs and increases reliability of the testing process by eliminating the need for a person to physically go to each emergency light, initiate tests, and record the results of the tests.

The central control unit is located in a convenient location. A flat panel, touch screen provides the user interface for the system. The flat panel is designed to be recess or surface mounted on a wall or console. Using the simple touch screen interface, the operator views test reports, schedules tests, initiates tests, and sends commands to the emergency lighting units.

Both the central control unit and the emergency lighting units include radio transceivers which permit communications between the units. For very large buildings or where radio interference is a problem, the invention uses a repeater. The repeater is positioned in a location where it can receive and transmit radio signals between the control unit and the emergency lighting units. Radio frequency communications also saves the time and expense of installing wire communications lines.

When the system is initially installed, the control unit automatically learns the ID numbers of all the emergency lighting units in the building. The control unit broadcasts a command to all lighting units causing them to transmit a reply. The control unit stores the ID numbers of all the replies received. This feature simplifies installation and is also useful when installing additional lighting units.

The central control unit contains a testing schedule which is stored in memory. The schedule preferably conforms to local or national safety codes. When a test is scheduled, the control unit sends a command to the specific lighting unit to initiate the test. The command specifies the type and duration of test to be performed. During long duration tests (e.g., 90 minutes) the control unit periodically sends commands to the lighting unit to verify the test is proceeding.

When the test is complete, the lighting unit transmits a data packet to the central control unit. The data packet contains status data about the tests performed and the results of the tests. The control unit analyses the status data from the lighting unit and stores a report of the test in memory.

In addition to initiating tests and generating test reports, the control unit analyzes the status data for other purposes. The control unit determines the cause of a failure and also predicts future failures. Determining the cause of a failure facilitates a quick and cost effective repair. A failure is predicted, for example, by monitoring a parameter. If the parameter drifts closer to a fail limit value over a period of time, then the controller will notify the operator of a predicted failure. This test is easily implemented by storing a history of test results. The control unit analysis the test results to predict the failure.

The invention also monitors status data from the emergency lighting units to verify nominal light output of the lamp. Light output can be estimated by measuring an appropriate parameter (e.g., battery discharge current). If the current is less than a predetermined value, the inverter is put into a higher current output mode causing the lamp to output more light. Conversely, if the discharge current is too high, the inverter is put into a lower current output mode causing the lamp to output less light.

Therefore, an object of the invention is to provide an improved system and method for remotely testing and monitoring emergency lighting units.

A feature of the invention is a central control unit which is in communication with a plurality of remote emergency lighting units.

Another feature of the invention is a central control unit which initiates self tests of the emergency lighting units.

Another feature of the invention is a central controller which communicates with emergency lighting units via electromagnetic signals.

Another feature of the invention is a central control unit which generates and stores reports of test results.

Another feature of the invention is a central controller which automatically detects the emergency lighting units in a building.

Another feature of the invention is a repeater which relays messages between a central control unit and an emergency lighting unit.

Advantages of the invention include reduced operating costs, reliable scheduling of tests, reliable recording of test results, quick diagnosis of failures, advance prediction of failures, reduced installation costs, and automatic compliance with safety codes for periodic testing.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose only one of the various ways in which the invention may be practiced.

DESCRIPTION OF THE PREFERRED EMBODIMENT OF THE INVENTION

Figure 1:
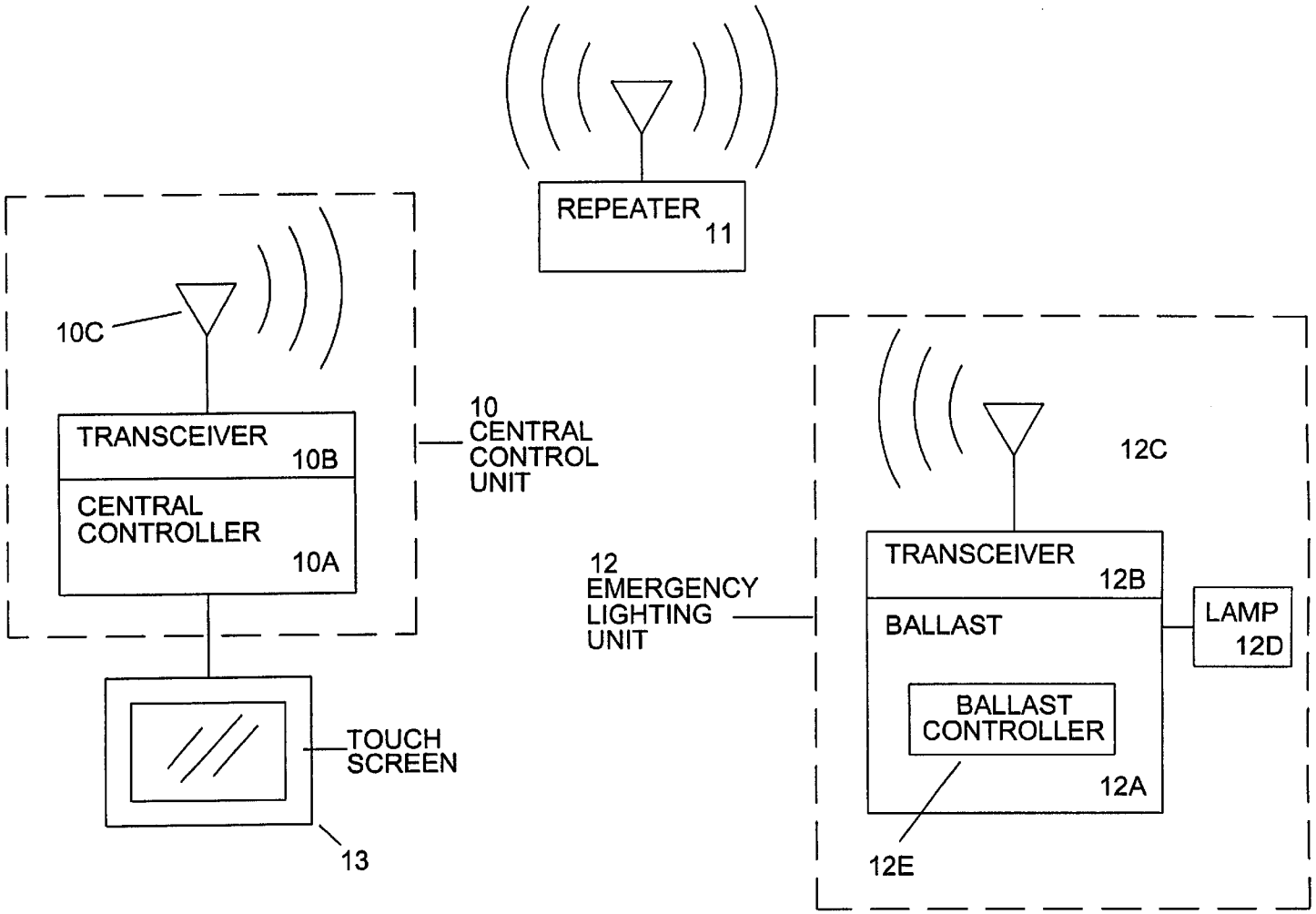
FIG. 1 is a block diagram of the preferred embodiment of the invention.

FIG. 1 is a block diagram of the preferred embodiment of the invention. Shown in FIG. 1 are central control unit 10, repeater 11, emergency lighting unit 12, and user interface 13. Central control unit 10 communicates with emergency lighting unit 12 via wireless radio signals. Repeater 11 relays signals between control unit 10 and lighting unit 12 when distance or interference prevents direct communication.

Emergency lighting unit 12 comprises ballast 12A, ballast transceiver 12B, ballast antenna 12C, and lamp 12D. Lighting unit 12 differs from the prior art in several aspects. Lighting unit 12 includes the addition of ballast transceiver 12B, antenna 12C, and ballast controller 12E. Ballast transceiver 12B and antenna 12C provide remote communication with control unit 10. Ballast controller 12E interfaces with transceiver 12B and coordinates self testing of emergency lighting unit 12. There may be up to 500 lighting units 12 located throughout a building or facility. All of the lighting units 12 are controlled by a single central control unit 10.

Central control unit 10 comprises central controller 10A, central transceiver 10B, and central antenna 10C. Central controller 10A sends commands to lighting units 12 via central transceiver 10B. Commands are either broadcast to all lighting units 12 or transmitted to specific lighting unit 12. Each lighting unit 12 has a unique ID number to permit one-to-one communications. Commands include an initiate test command, an are-you-there command, lamp on/off commands, status request command, and activate LEDs and audible alarm commands.

The initiate test command causes a lighting unit 12 to initiate a self-test. The self-test is either a 30 second test or 90 minute test. Both tests include a battery voltage test and a lamp current test. For purposes of this application, the terms lamp current and battery discharge current are virtually synonymous. The are-you-there command is broadcast to all lighting units 12. This command causes all of the lighting units to transmit a reply. The central controller 10A then "learns" the ID numbers of all the lighting units in the building. The lamp on/off command causes lighting unit 12 to turn its lamp on or off. The status request command causes a lighting unit 12 to reply with its current status information. Lighting unit 12 status data includes whether it passed or failed its last test and if it is currently in the process of performing a test. The activate LEDs and audible alarm commands cause lighting unit 12 to illuminate its failure LEDs 31F and activate its audible alarm 31G. This command is useful when a specific lighting unit 12 needs to be located. If central controller 10A does not receive a reply from a lighting unit 12 within a predetermined time-out period, central controller 10A logs a failure. Central control unit 10 is in communication with user interface 13.

User interface 13 is a flat panel touch screen device. It is recess or surfaced mounted on a wall or a console. User interface 13 is in communication with control unit 10 and allows an operator to control all aspects of the emergency lighting system throughout the building. The operator can enter commands, schedule tests, view test reports, and perform other functions via user interface 13.

Figure 2:
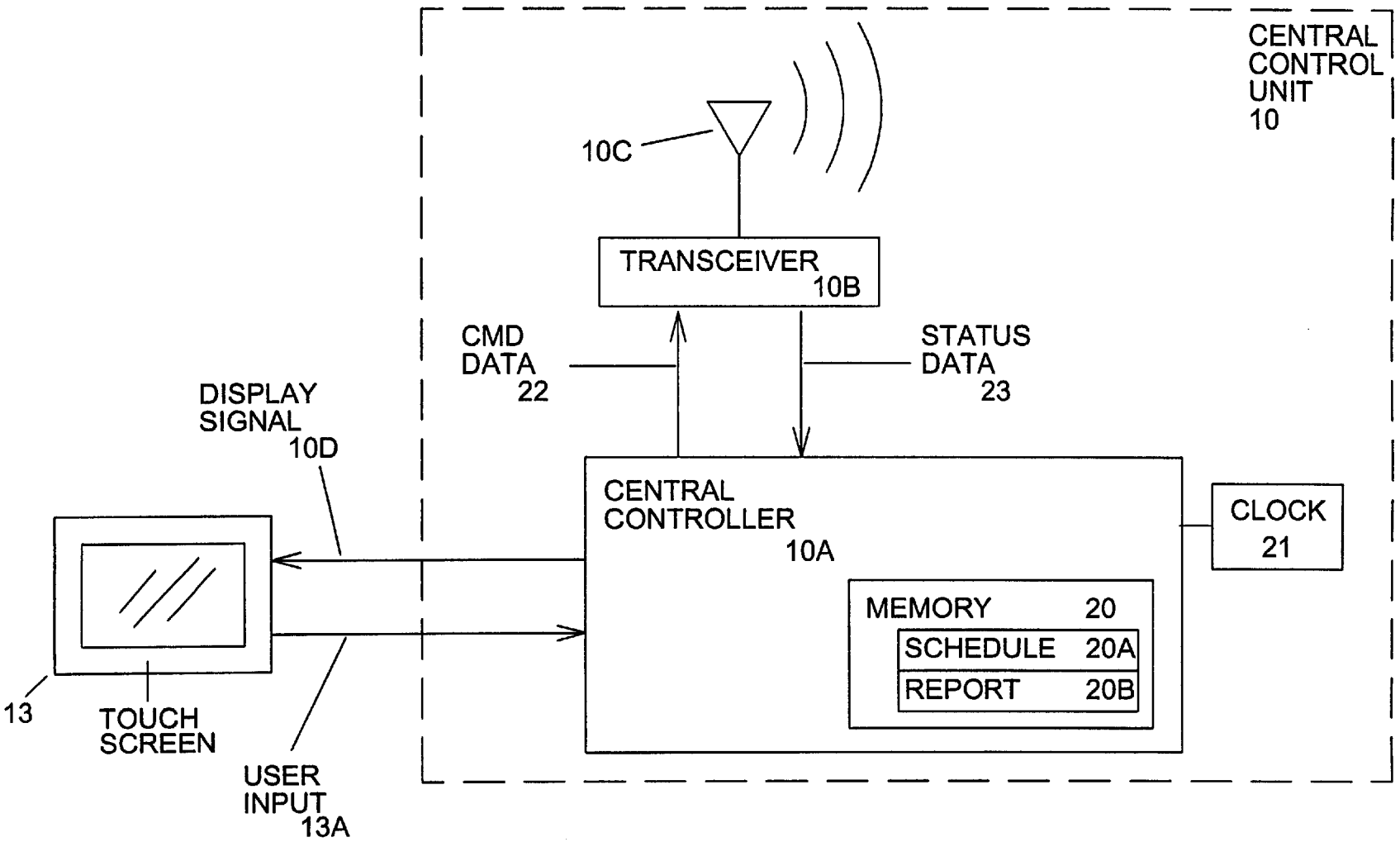
FIG. 2 is a block diagram of the central control unit.

FIG. 2 is a more detailed block diagram of control unit 10 and user interface 13. Central controller 10A coordinates the automatic testing of lighting units 12. The preferred embodiment uses a PIC16C76B microcontroller manufactured by Microchip Technology Inc. which is located in Chandler, Ariz. This microcontroller has onboard RAM and ROM memories which are used to implement memory 20.

Memory 20 includes schedule memory 20A and report memory 20B. Schedule memory 20A stores schedule data which specifies when tests will be performed and what type of test to perform. Schedule memory 20A is initially loaded with a test schedule in compliance with Section 5–9.3 of the Life Safety Code. The Code dictates that every required emergency lighting system undergo a functional test at 30 day intervals for a minimum of 30 seconds and an annual test for a duration of 90 minutes. An operator can modify the test schedule and can command that tests be performed at any time desired.

Report memory 20B stores report data indicating the results of tests performed on lighting units 12. Report data includes the date and time of each test, the ID of the lighting unit tested, and the result of the test. The test report is displayed on user interface 13 and allows an operator to easily verify that all lighting units 12 are functioning properly. Report memory 20B and schedule memory 20A are a part of central controller 10A.

Central controller 10A communicates with user interface 13 and emergency lighting units 12. Central controller 10A receives user input signal 13A from user interface 13 and sends a display signal 10D to user interface 13. Central controller 10A generates command data signal 22 as a function of user input signal 13A and schedule data in schedule memory 20A. Command data signal 22 contains commands and data for controlling lighting units 12. Command data signal 22 is transmitted to lighting units 12 via central transceiver 10B.

Clock 21 provides date and time information to central controller 10A. Clock 21 has a self-contained battery so that central controller 10A always has the correct date and time even after a power failure or reset.

Central transceiver 10B, repeater 11, and ballast transceiver 12B provide communications links between the components of the invention. All of the transceivers are implemented using Micro Pulse, half duplex transceivers manufactured by World Wide Communications of West Valley, Utah. Communications are performed at a frequency of 2.4 GHz and use spread spectrum frequency hopping technology. Central transceiver 10B is configured as the master and ballast transceivers 12B are configured as slaves. A frequency hop is done every 100 milliseconds which provides sufficient time for either a packet of command data 22 to be transmitted to a lighting unit 12 or a packet of status data 23 to be transmitted to central control unit 10 between frequency hops.

Figure 3:
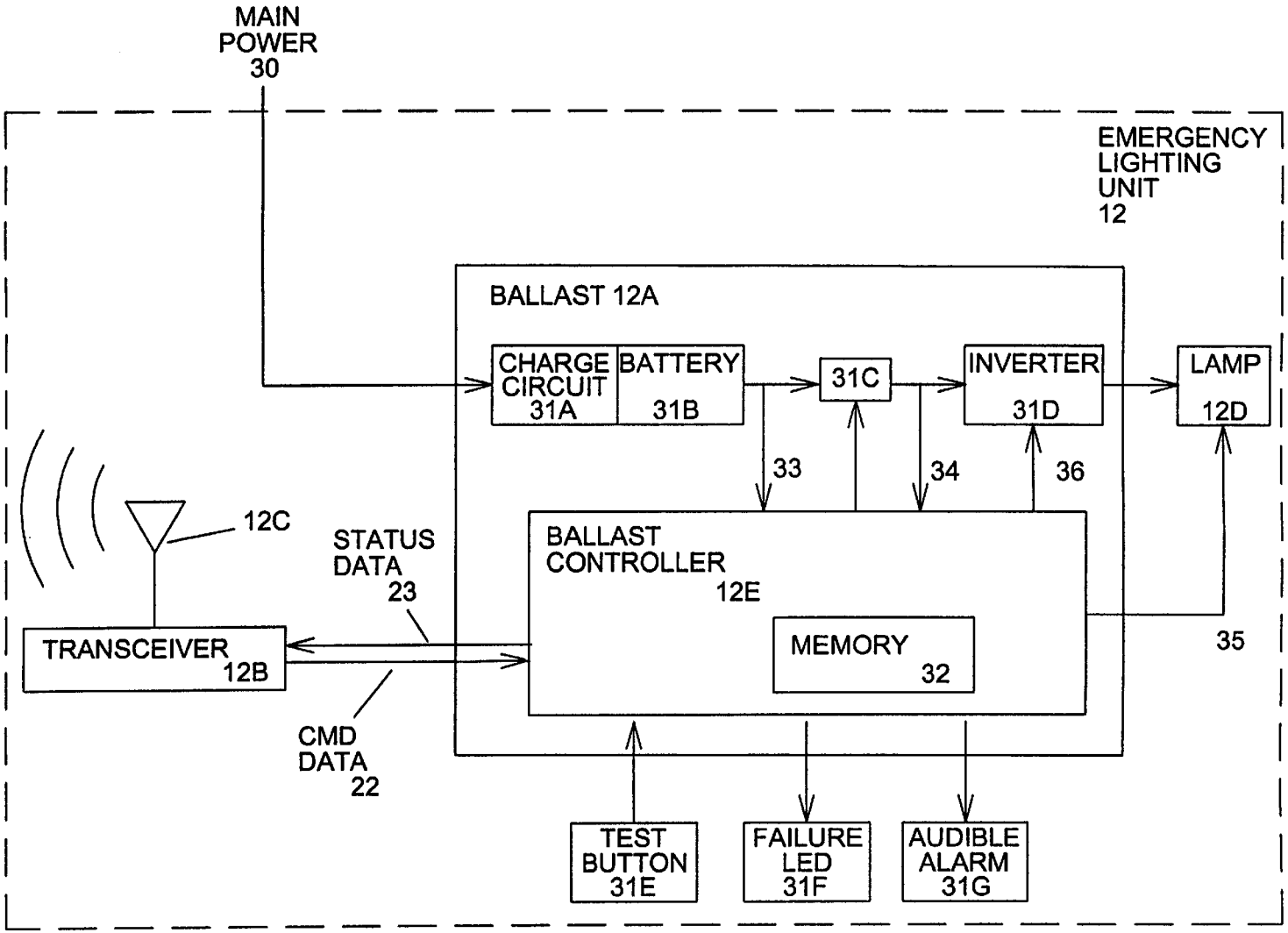
FIG. 3 is a block diagram of an emergency lighting unit.

FIG. 3 is a more detailed block diagram of emergency lighting unit 12 for a flourescent lamp. Lighting unit 12 has many elements in common with prior art emergency ballasts. Shown in FIG. 3 are main power 30, battery charge circuit 31A, battery 31B, switch 31C, inverter 31D, test button 31E, failure LED's 31F, and audible alarm 31G. These components function in a conventional manner.

Main power 30 provides power to lamp 12D via conductors (not shown) and charges battery 31B during normal operation. When main power 30 is interrupted, switch 31C is closed so that battery 31B provides electrical power to lamp 12D via inverter 31D. Inverter 31D converts direct current into high frequency alternating current for use by flourescent lamps.

Test button 31E, failure LED's 31F, and audible alarm 31G function in a conventional manner. Test button 31E causes ballast controller 12E to initiate a self test. Failure LED's 31F illuminate to indicate a failure. Similarly, audible alarm 31G is activated to indicate a failure. A new feature of the invention activates LED's 31F and alarm 31G as part of the "find lamp" command. The "find lamp" command is initiated by an operator entering a command at user interface 13. Central controller 10A sends a command to a specific lighting unit 12 to activate its LED's 31F and audible alarm 31G. This makes it easier to locate a specific lighting unit 12.

Two differences from the prior art include the addition of ballast transceiver 12B and ballast controller 12E. Ballast transceiver 12B and ballast antenna 12C provide a communications link with central control unit 10 as discussed above. Ballast controller 12E communicates with ballast transceiver 12B. Controller 12E sends status data 23 to transceiver 12B and receives command data 22 from transceiver 12B.

Ballast controller 12E coordinates automatic testing and interfaces with many other components of ballast 12A. The preferred embodiment uses a PIC16C76B microcontroller manufactured by Microchip Technology Inc. which is located in Chandler, Ariz. This microcontroller has onboard RAM and ROM memories and an onboard A/D converter. Ballast memory 32 is implemented in these onboard memories. Program data is stored in ROM and dynamic variables and data are stored in RAM.

Ballast controller 12E performs self tests and other functions responsive to command data 22 received from central controller 10A. Controller 12E performs 30 second and 90 minute tests on ballast 12A. Conventional tests include battery voltage testing via battery voltage signal 33 and lamp current testing via current signal 34. Both tests are known in the art and will be described only briefly. The voltage test senses the voltage across battery 31B during a test. A failure is logged if the voltage drops below a predetermined level. The lamp current test senses the voltage drop across a resistive element and uses Ohm's Law to determine current. A failure is logged if the current is outside of a predetermined range. Voltages are measured using the A/D converter which is part of ballast controller 12E. Other types of tests known in the art can also be performed. It is envisioned that future tests can also be used with the invention. Other types of tests are taught in Applicant's co-pending U.S. patent application entitled "EMERGENCY LIGHTING TEST SYSTEM AND METHOD," Ser. No. 09/556,103, filed on Apr. 21, 2000, by Conley III et al., and is incorporated herein by reference.

Ballast controller 12E communicates the results of the tests to central control unit 10 in status data 23. Status data 23 is transmitted to control unit 10 via ballast transceiver 12B. Status data 23 includes data such as which tests passed, which tests failed, and the value of parameters measured during the tests. The value of the measured parameters allows central controller 10A to evaluate the test results. For example, central controller 10A can determine if a lighting unit 12 is getting close to failing or if it failed by a small margin or a large margin. This is useful in predicting and diagnosing failures. For example, if a parameter value trends toward a predetermined limit over a period of time, central controller 10A predicts a failure will occur.

Ballast controller 12E also makes adjustments to lighting units 12. It is useful for the ballast controller 12E to make sure that lamp 12D is producing a nominal amount of light. Lamp light output is a function of certain parameters (e.g., lamp current and battery discharge current). If the measured lamp current is outside of a predetermined range, ballast controller 12E adjusts inverter 31D via lamp selector 36. Lamp current is adjusted to either increase or decrease as necessary. An increase in lamp current causes lamp 12D to output more light. A decrease in lamp current causes lamp 12D to output less light.

Ballast controller 12E also responds to other commands from central control unit 10. In reply to a status inquiry, controller 12E responds with the current status of lighting unit 12. In response to an are-you-there command, controller 12E merely replies. In response to a lamp on or off command, controller 12E turns the lamp on or off via lamp control signal 35. In response to a find lamp command, controller 12E activates LED's 31F and audible alarm 31G.

Data packets are used to transmit data between central controller 10A and emergency lighting units 12A. Data packets are designed to be compact so that a complete data packet can be transmitted between frequency hops. Data packets comprise a lamp ID field, a number of bytes field, a command field, a data bytes field, and checksum field.

The lamp ID field contains the unique identification number for transmitting or receiving lighting unit 12. This allows each lighting unit 12 to be addressed individually. Lamp ID numbers range from zero to 500. The number of bytes field tells the receiving unit how many data bytes to expect in the packet. The command field contains command codes. The commands include, but are not limited to, the "perform 30 second test" command, the "perform 90 minute test" command, the "status request" command, the "find lamp" command, the "lamp on/off" command, and the "are-you-there" command.

Figure 4:
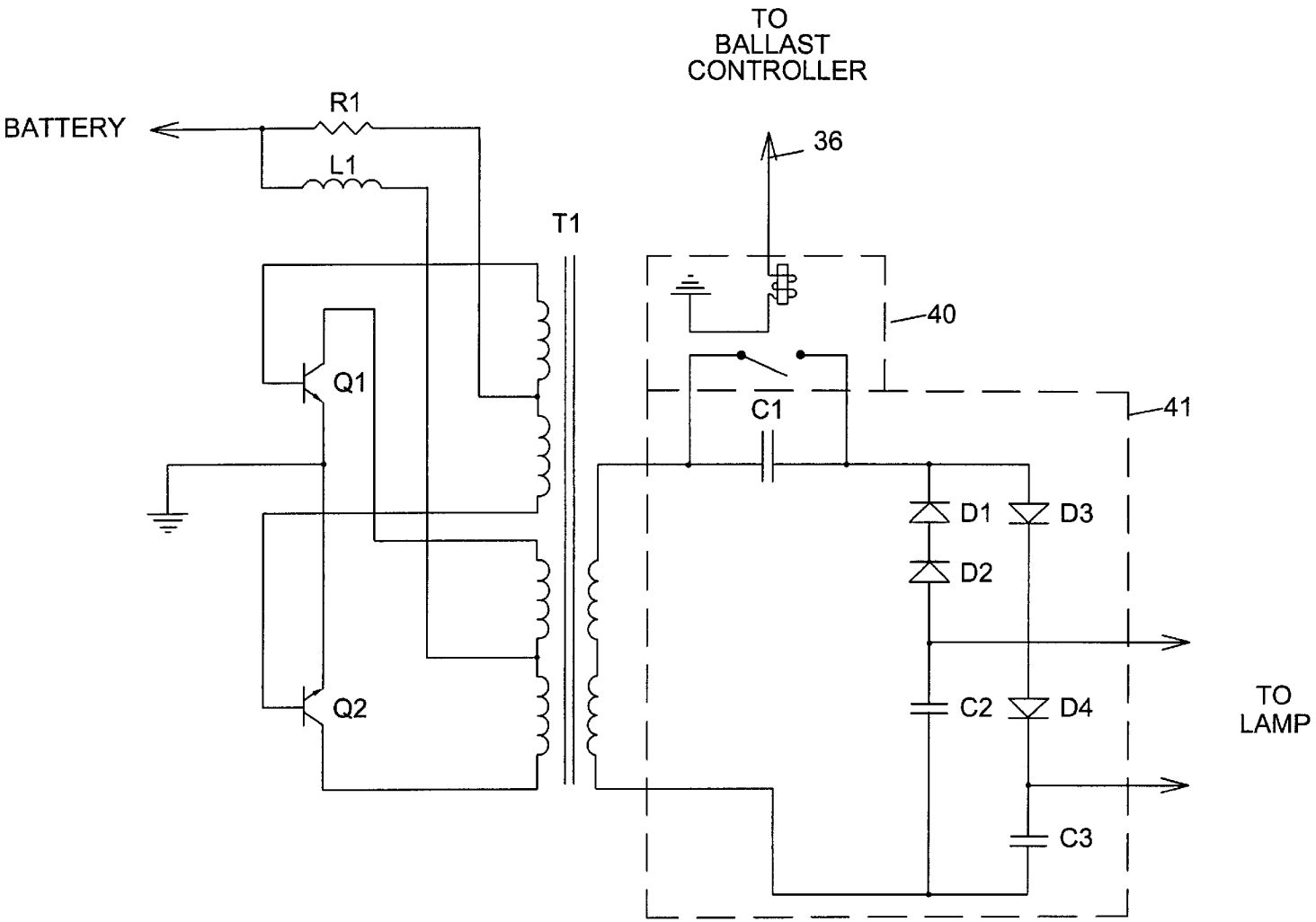
FIG. 4 is a circuit diagram illustrating the current altering feature of the inverter.

FIG. 4 is a circuit diagram of a portion of the inverter 31D which shows the lamp selector feature. Inverter 31D is constructed in a known manner except for lamp selector switch 40. Inverter includes transformer T1 which has a secondary which feeds into resonant circuit 41. Closing switch 40 causes capacitor C1 to be shorted and increases battery discharge current. Conversely, opening switch 40 reduces battery discharge current. Thus there is created two lamp current modes. Preferred battery discharge current is two amperes. If battery discharge current drops to 1.8 amps, switch 40 is closed and battery discharge current is raised above 2.0 amps. If battery discharge current raises above 2.2 amps, switch 40 is opened and battery discharge current is reduced to about 2.0 amps. The remainder of the circuit operates in a conventional manner known to those skilled in the art and will not be described in detail.

The method of the invention follows from the description above. The method includes the steps of:

(a) providing a ballast having a ballast transceiver and a ballast controller in communication with the ballast transceiver.

(b) providing a central control unit having a central transceiver in communication with the ballast transceiver and a central controller in communication with the central transceiver, the central controller having a schedule memory containing schedule data.

(c) communicating command data from the central control unit to the ballast. The command data may include any of the commands discussed in the description above including the initiate self test command.

(d) communicating status data from the ballast to the central control unit. The status data including results of self tests performed by the ballast controller.

(e) storing the test results in memory.

(f) communicating a test failure to a user interface.

(g) predicting test failures as a function of parameter value changes over time and communicating said predictions to a user interface.

(h) computing repair suggestions as a function of status data and communicating said suggestions to a user interface.

Various changes in the details, steps and components that have been described may be made by those skilled in the art within the principles and scope of the invention herein illustrated and defined in the appended claims. For example, various kinds of components, memories, circuits, test methods, controllers, and radios could be used with equivalent results. Similarly, various physical embodiments are also envisioned. Thus, while the present invention has been shown and described herein in what is believed to be the most practical and preferred embodiment, it is recognized that departures can be made therefrom within the scope of the invention, which is not to be limited to the details disclosed herein but is to be accorded the full scope of the claims so as to embrace any and all equivalent processes and products.

I claim:

1. A wireless remotely controlled emergency lighting system comprising:

(a) an emergency lighting unit having,
  (1) a ballast transceiver, and
  (2) a ballast controller in communication with said ballast transceiver; said controller receiving command data from said ballast transceiver and sending status data to said ballast transceiver; and (b) a central control unit having,
  (1) a central transceiver in communication with said ballast transceiver, and
  (2) a central controller in communication with said central transceiver; said central controller receiving said status data from said central transceiver and sending said command data to said central transceiver.

2. The wireless remotely controlled emergency lighting system according to claim 1 further comprising a user interface in communication with said central controller; said user interface generating a user input signal representative of inputs by an operator.

3. The wireless remotely controlled emergency lighting system according to claim 1 wherein said central controller includes a schedule memory and wherein said central controller generates said command data responsive to schedule data in said schedule memory.

4. The wireless remotely controlled emergency lighting system according to claim 2 wherein said central controller generates said command data responsive to said user input signal.

5. The wireless remotely controlled emergency lighting system according to claim 1 wherein said ballast controller performs a self test on said emergency lighting unit and generates said status data as a function of the result of said self test.

6. The wireless remotely controlled emergency lighting system according to claim 1 wherein said central controller includes a report memory and said central controller generates report data as a function of said status data and stores said report data in said report memory.

7. The wireless remotely controlled emergency lighting system according to claim 6 wherein said central controller communicates said report data to a user interface.

8. The wireless remotely controlled emergency lighting system according to claim 1 wherein said central controller broadcasts an "are-you-there" command to said ballast controller to initiate a reply from said ballast transceiver.

9. The wireless remotely controlled emergency lighting system according to claim 1 wherein said central controller logs a failure when a reply is not received from said ballast transceiver within a predetermined time-out period.

10. The wireless remotely controlled emergency lighting system according to claim 1 wherein said central controller sends a status request command to said ballast controller when said ballast controller is performing a self test.

11. The wireless remotely controlled emergency lighting system according to claim 1 further comprising a repeater; said repeater in communication with said central transceiver and said ballast transceiver; said repeater relaying command data and status data between said central transceiver and said ballast transceiver.

12. The wireless remotely controlled emergency lighting system according to claim 1 wherein said emergency lighting unit includes an audible alarm; said audible alarm in communication with said ballast controller; wherein said ballast controller activates said audible alarm as a function of said command data.

13. The wireless remotely controlled emergency lighting system according to claim 1 wherein said lighting unit includes an inverter in communication with said ballast controller, said inverter having at least two lamp current modes.

14. A method of remotely controlling and monitoring emergency lighting units, said method comprising the steps of:

(a) providing a ballast, said ballast having,
  (1) a ballast transceiver, and
  (2) a ballast controller in communication with said ballast transceiver;

(b) providing a central control unit having,
  (1) a central transceiver in communication with said ballast transceiver, and
  (2) a central controller in communication with said central transceiver, said central controller having a schedule memory containing schedule data; and, (c) communicating command data from said central control unit to said ballast.

15. An emergency lighting system comprising:

(a) an emergency lighting unit having,
  (1) a lamp;
  (2) a backup power supply in communication with said lamp;
  (3) a switch coupled between said power supply and said lamp; and
  (4) a ballast controller coupled to said backup power supply, said ballast controller generating status data representative of the results of self tests of said emergency lighting unit; and (b) a central controller in communication with said ballast controller, said central controller having a memory, storing said status data in said memory, generating a prediction of a failure as a function of said status data, and communicating said prediction to a user interface;

wherein said user interface is in communication with said central controller, said user interface communicating said status data to an operator.

16. The emergency lighting system according to claim 15 wherein there are a plurality of said emergency lighting units and said central controller communicates a self test command to at least one of said emergency lighting units.

17. The emergency lighting system according to claim 15 wherein said central controller includes a schedule memory and said central controller generates command data as a function of schedule data in said schedule memory.

18. The emergency lighting system according to claim 15 wherein said central controller diagnoses a cause of a failure as a function of said status data.

* * * * *